US008777356B2

(12) United States Patent
Fujii et al.

(10) Patent No.: US 8,777,356 B2
(45) Date of Patent: Jul. 15, 2014

(54) FLUID DISCHARGE HEAD SEMICONDUCTOR DEVICE, FLUID DISCHARGE HEAD, AND FLUID DISCHARGE APPARATUS

(71) Applicant: Canon Kabushiki Kaisha, Tokyo (JP)

(72) Inventors: Kazunari Fujii, Tokyo (JP); Masanobu Oomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 13/656,802

(22) Filed: Oct. 22, 2012

(65) Prior Publication Data

US 2013/0141483 A1 Jun. 6, 2013

(30) Foreign Application Priority Data

Dec. 5, 2011 (JP) ..... 2011-266275

(51) Int. Cl.
*B41J 29/38* (2006.01)

(52) U.S. Cl.
USPC ..... 347/14; 347/40; 347/50

(58) Field of Classification Search
USPC ..... 347/9, 12, 14, 15, 19, 20, 40, 50, 58
See application file for complete search history.

(56) References Cited

U.S. PATENT DOCUMENTS 6,648,445 B2 * 11/2003 Ishizawa et al. ..... 347/19
8,348,377 B2 * 1/2013 Asauchi ..... 347/19

FOREIGN PATENT DOCUMENTS

JP 9-314834 A 12/1997

* cited by examiner

*Primary Examiner* — Thinh Nguyen
(74) *Attorney, Agent, or Firm* — Fitzpatrick, Cella, Harper & Scinto

(57) ABSTRACT

A fluid discharge head semiconductor device, comprising a terminal unit including first pad group including a plurality of pads, a processing unit configured to process input information from the first pad group, a printing unit including a plurality of printing elements configured to discharge a printing material in accordance with a result of the processing, and an inspection output unit including second pad group including at least one pad and an output buffer unit, wherein the processing unit outputs information on an inspection of an operation to the inspection output unit, and the inspection output unit drives the output buffer unit to output the information to the second pad group when performing an inspection, and suppresses the driving of the output buffer unit when performing printing.

7 Claims, 12 Drawing Sheets

FLUID DISCHARGE HEAD SEMICONDUCTOR DEVICE, FLUID DISCHARGE HEAD, AND FLUID DISCHARGE APPARATUS

BACKGROUND OF THE INVENTION

1. Field of the Invention

The present invention relates to a fluid discharge head semiconductor device, fluid discharge head, and fluid discharge apparatus.

2. Description of the Related Art

A fluid discharge head semiconductor device drives a plurality of printing elements to discharge a printing material toward printing paper. An electrothermal transducer is used as the printing element, and the printing material is discharged by applying heat. The number of printing elements of the fluid discharge head semiconductor device has increased as the image quality improves.

On the other hand, the fluid discharge head semiconductor device includes an inspection unit for performing an inspection in the stage of manufacture or shipment. This inspection is performed to prevent a material defect such as a discharge amount variation of the printing material, or a functional defect caused by a logical defect.

The inspection unit requires an inspection output unit having a high driving force, in order to output inspection results or relevant information to an external inspection apparatus. This inspection output unit generates considerable heat, and can give a nonuniform temperature distribution to a substrate of the fluid discharge head semiconductor device. This may vary the discharge amount of the printing material, and as a consequence may deteriorate the image quality.

SUMMARY OF THE INVENTION

The present invention provides a fluid discharge head semiconductor device advantageous in improving the image quality.

One of the aspects of the present invention provides a fluid discharge head semiconductor device, comprising a terminal unit including first pad group including a plurality of pads, a processing unit configured to process input information from the first pad group, a printing unit including a plurality of printing elements configured to discharge a printing material in accordance with a result of the processing, and an inspection output unit including second pad group including at least one pad and an output buffer unit, wherein the processing unit outputs information on an inspection of an operation to the inspection output unit, and the inspection output unit drives the output buffer unit to output the information to the second pad group when performing an inspection, and suppresses the driving of the output buffer unit when performing printing.

Further features of the present invention will become apparent from the following description of exemplary embodiments with reference to the attached drawings.

DESCRIPTION OF THE EMBODIMENTS

Figure 1:
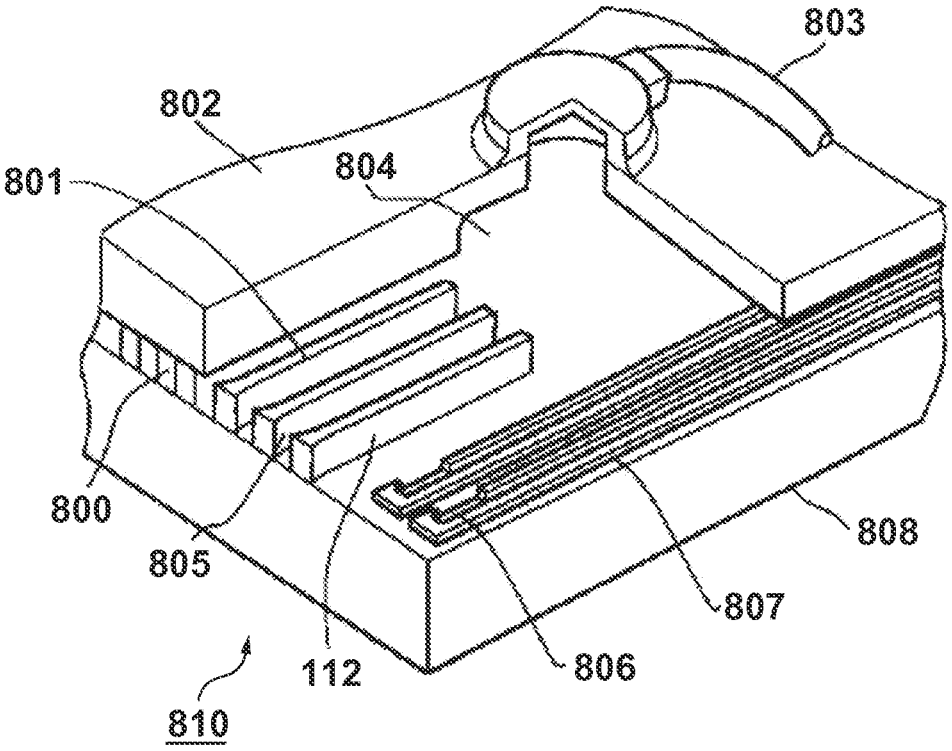
FIG. 1 is a view for explaining an internal arrangement example of a fluid discharge head.

Prior to the explanation of each embodiment of a fluid discharge head semiconductor device of the present invention, the operation principle of a fluid discharge head 810 will be explained with reference to FIG. 1. The fluid discharge head 810 can include, on a substrate 808, channel wall members 801 for forming fluid channels 805, and a top plate 802 including a printing material supply unit 803. The fluid discharge head 810 can also include heat generation units 806 as printing elements. A printing material injected from the printing material supply unit 803 can be stored in a common ink chamber 804, and supplied to each fluid channel 805. The printing material can flow to each of a plurality of orifices 800 through the fluid channel 805. The fluid discharge head 810 can discharge the printing material from the orifices 800 by driving the heat generation units 806. More specifically, the discharge amount of the printing material may increase when the temperature of the printing material is high, and may reduce when the temperature of the printing material is low.

First Embodiment

Figure 2:
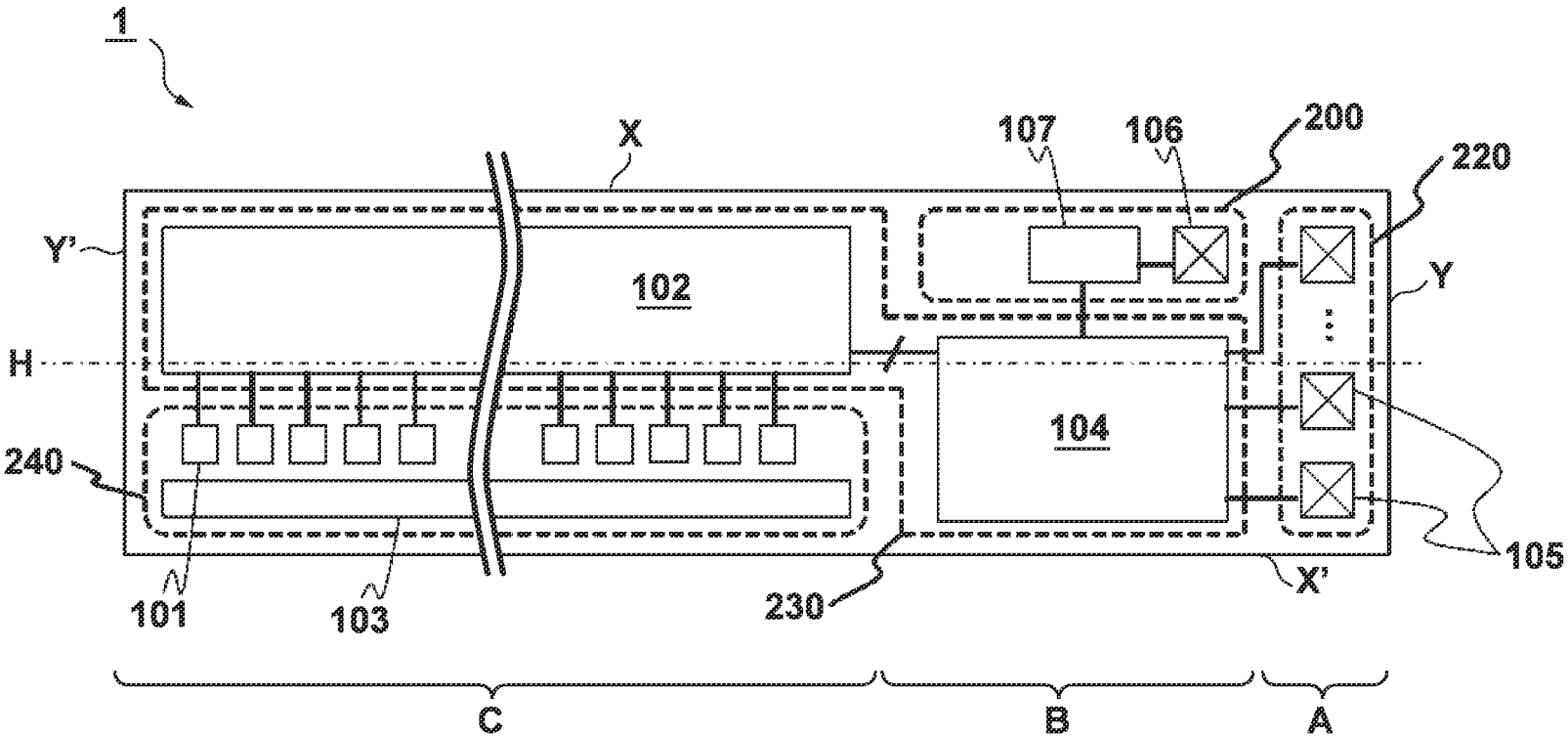
FIG. 2 is a view for explaining an arrangement example of a fluid discharge head semiconductor device of the first embodiment.

A fluid discharge head semiconductor device 1 of the first embodiment will be explained below with reference to FIGS. 2 to 6. As shown in FIG. 2, the fluid discharge head semiconductor device 1 can include a terminal unit 220, processing unit 230, printing unit 240, and inspection output unit 200. These units can be formed on the same substrate by, for example, a standard process of manufacturing a large-scale integrated circuit (LSI).

The terminal unit 220 can include first pad group 105, including a plurality of pads. The first pad group 105 can include a terminal for inputting character information, image information, and the like from an external apparatus, and a power supply terminal. The processing unit 230 can process input information from the first pad group 105, and output information on an inspection for the operation of this processing to the inspection output unit 200. The printing unit 240 can include a plurality of printing elements 101 for discharging a printing material in accordance with the processing result from the processing unit 230. As the printing element 101, it is possible to use a heater that generates heat to discharge the printing material, for example, an electrothermal transducer such as a resistor. Also, the printing unit 240 can include a printing material supply unit 103 for supplying the printing material to the plurality of printing elements 101.

The processing unit 230 can include a logic unit 104 and driving unit 102. Signal lines from the first pad group 105 can be connected to the logic unit 104. The logic unit 104 can control the driving unit 102 in accordance with input information from the first pad group 105. Also, the logic unit 104 can perform an inspection of this operation, and output information on the inspection. This inspection can be performed by self-diagnosis by the logic unit 104, and partial information on the inspection result can be output to an external inspection apparatus 111 (to be described later) and diagnosed outside. The driving unit 102 can be connected to each of the plurality of printing elements 101, and drive each of the plurality of printing elements under the control of the logic unit 104. More specifically, the driving unit 102 can supply a desired electric current for generating heat to each of the plurality of printing elements 101.

The inspection output unit 200 can include second pad group 106, including at least one pad, and an output buffer unit 107. As described previously, the processing unit 230 can output, to the output buffer unit 107, information on the processing of input information from the first pad group 105, and information on an inspection of the operation of the processing. The information on the inspection can be the inspection result itself, and can also be a part of information to be used to perform an inspection in the external inspection apparatus 111.

Figure 3:
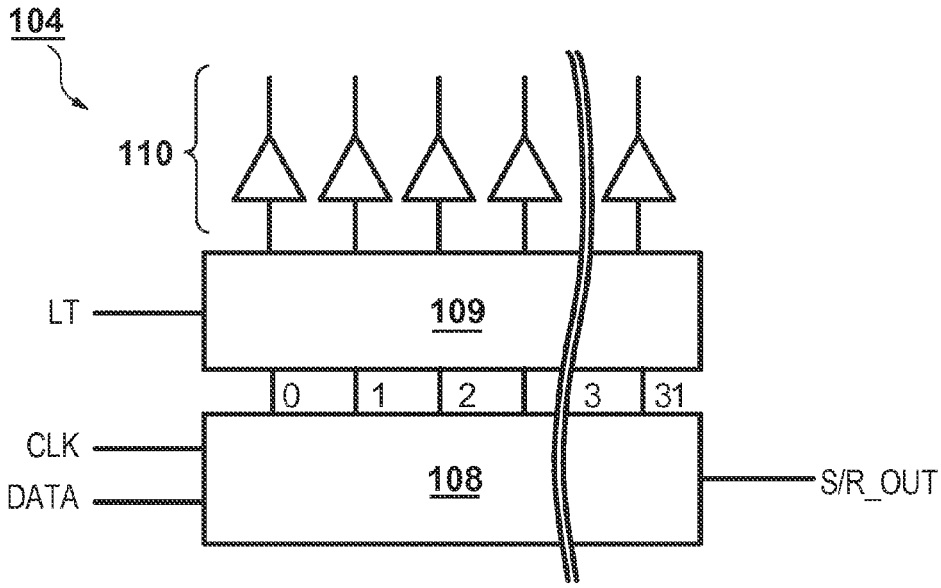
FIG. 3 is a view for explaining an arrangement example of a processing unit of the first embodiment.

As shown in FIG. 3, the logic circuit 104 can include a shift register circuit unit 108, a latch circuit unit 109, and amplifiers 110. The shift register circuit unit 108 can be, e.g., a 32-bit shift register, and include output terminals for 32 bits. The latch circuit unit 109 can include latch circuits equal in number to the output terminals of the shift register circuit 108. The 32-bit output terminals of the shift register circuit unit 108 can be connected to a plurality of latch circuits of the latch circuit unit 109. The shift register circuit unit 108 can also include an input terminal for a transfer clock signal CLK, and an input terminal for a data signal DATA. The data signal DATA can serially apply input information (for example, image data) from the first pad group 105. The latch circuit unit 109 can also include an input terminal for receiving a latch signal LT. An output from each of the plurality of latch circuits of the latch circuit unit 109 can be input to a corresponding one of the plurality of amplifiers 110. The outputs of the plurality of amplifiers 110 can be connected to the driving unit 102 for driving the plurality of printing elements 101.

Figure 4:
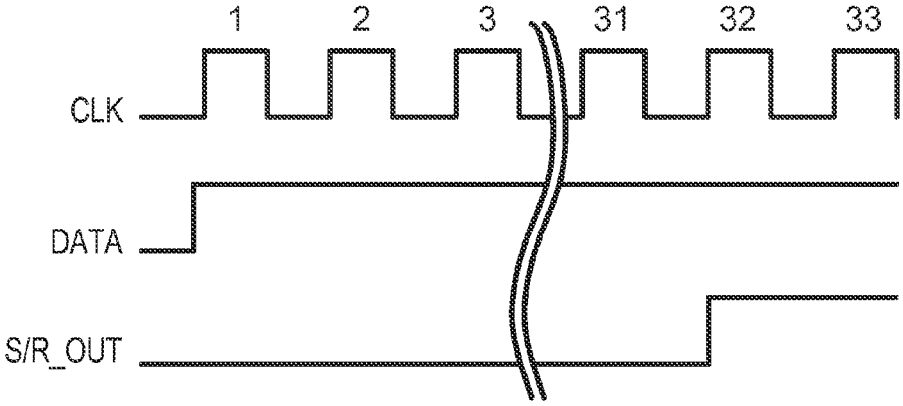
FIG. 4 is a view for explaining an example of a timing chart of a shift register circuit unit of the first embodiment.
Figure 5:
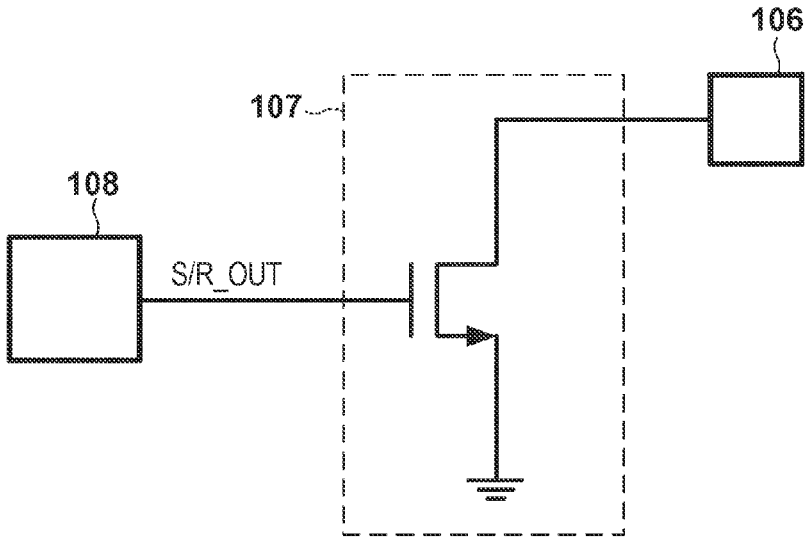
FIG. 5 is a view for explaining an arrangement example of an inspection output unit of the first embodiment.
Figure 6:
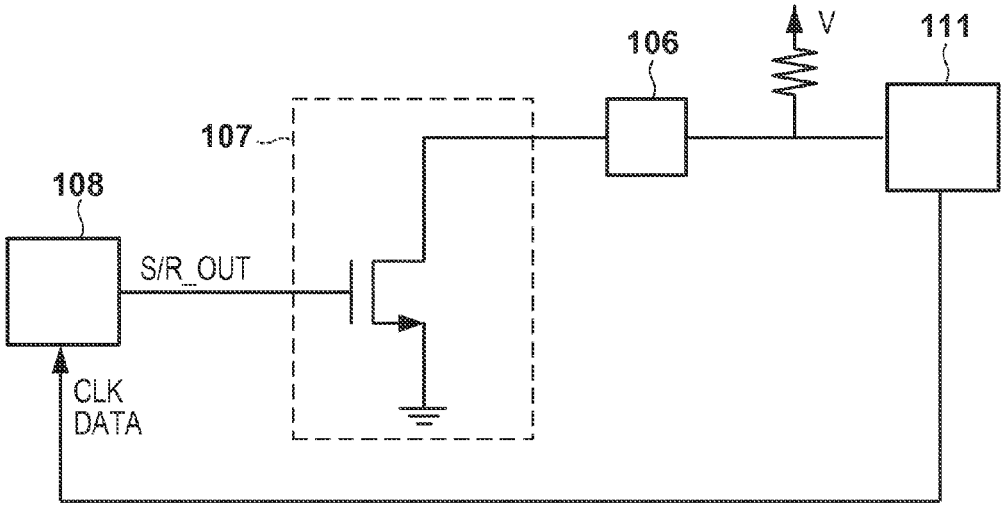
FIG. 6 is a view for explaining an arrangement example in an inspection mode of the first embodiment.

In this embodiment, an inspection is performed on the shift register circuit unit 108 in the stage of manufacture or shipment. When performing this inspection, the shift register unit 108 can output an output signal as a signal S/R_OUT from the final stage to the output buffer unit 107. As shown in FIG. 4, a signal obtained by delaying the signal DATA by 32 clocks can be output as the signal S/R_OUT. After that, the inspection can be performed by determining whether the signal S/R_OUT matches, for example, the signal DATA. As shown in FIG. 5, the output buffer unit 107 includes an NMOS transistor open drain output unit, and the drain terminal can be connected to the second pad group 106. As shown in FIG. 6, the inspection can be performed by monitoring the potential of the second pad group 106 by using the external inspection apparatus 111. The signal S/R_OUT can be supplied to the external inspection apparatus 111 by using a pull-up resistor.

On the other hand, in a normal use state in which printing is performed, the driving current of the output buffer unit 107 can be interrupted by opening the second pad group 106. In this state, the second pad group 106 is fixed to the GND potential (ground potential). Alternatively, the output of the output circuit and the above-mentioned test pad are preferably electrically insulated, in order to reduce noise and interference to signal lines near the second pad group 106. When performing the inspection as described above, the output buffer unit 107 can be driven to output information on the inspection to the second pad group 106. Also, when performing printing, the inspection output unit 200 can suppress the driving of the output buffer unit 107.

Accordingly, the inspection output unit 200 can prevent heat generation in the output buffer unit 107, so the fluid discharge head semiconductor device 1 can achieve high image quality by suppressing the variation in printing material discharge amount. The suppression of the driving of the output buffer unit 107 herein mentioned can include a state in which the heat amount generated by the output buffer unit 107 in the normal use state in which printing is performed is smaller than that when performing the inspection. Also, the second pad group 106 includes a single pad in FIG. 2 but can include a plurality of pads in accordance with the scale of the output buffer unit 107.

Furthermore, the fluid discharge head semiconductor device 1 includes a considerable number of printing elements 101 as shown in FIG. 2, and hence can have a rectangular shape having two long sides (X and X') and two short sides (Y and Y'). The fluid discharge head semiconductor device 1 can include a first area A, second area B, and third area C in this order from the side Y to the side Y' of the two short sides. The terminal unit 220 can be formed in the first area A, the inspection output unit 200 can be formed in the second area B, and the printing unit 240 can be formed in the third area C. The processing unit 230 can be formed from the second area B to the third area C.

The length of the long sides X and X' can be determined by the number of printing elements 101 and the scale of the logic region, particularly, the number of printing elements 101. The length of the short sides Y and Y' can be determined by the scale of the first pad group 105, more specifically, the size, number, layout, or the like of the pads. In the normal use state in which printing is performed, the first pad group 105 that can constantly be used are preferably arranged along the short side Y because they can easily be connected to an external apparatus. On the other hand, the second pad group 106 that can be used in only the inspection mode are preferably arranged along the long side X or X' in order to reduce the chip area. This makes it possible to avoid the increase in length of the short sides Y and Y', thereby suppressing the increase in chip area of the fluid discharge head semiconductor device 1. As shown in FIG. 2, the inspection output unit 200 can be formed between a virtual line H and one (in this case, X) of the two long sides. Also, the printing unit 240 can be formed between the virtual line H and the other one (in this case, X') of the two long sides. As shown in FIG. 2, the virtual line H is a straight line virtually drawn between and parallel to the two long sides X and X'.

Thus, the fluid discharge head semiconductor device 1 can further reduce the influence which the heat that can be generated by the inspection output unit 200 has on the printing elements 101 and printing material supply unit 103. Referring to FIG. 2, the output buffer unit 107 and second pad group 106 of the inspection output unit 200 are juxtaposed in the direction of the long side X. However, the positions of the output buffer unit 107 and second pad group 106 may be switched, and they may also be juxtaposed in the direction of the short side Y. Furthermore, the output buffer unit 107 and second pad group 106 may be overlaid on each other (the circuit portion and pads may be formed in the same area).

As described above, the fluid discharge head semiconductor device 1 can reduce the influence of heat generation by the inspection output unit 200 on the plurality of printing elements 101. Therefore, the fluid discharge head semiconductor device 1 can achieve high image quality by suppressing the variation in printing material discharge amount.

Second Embodiment

Figure 7:
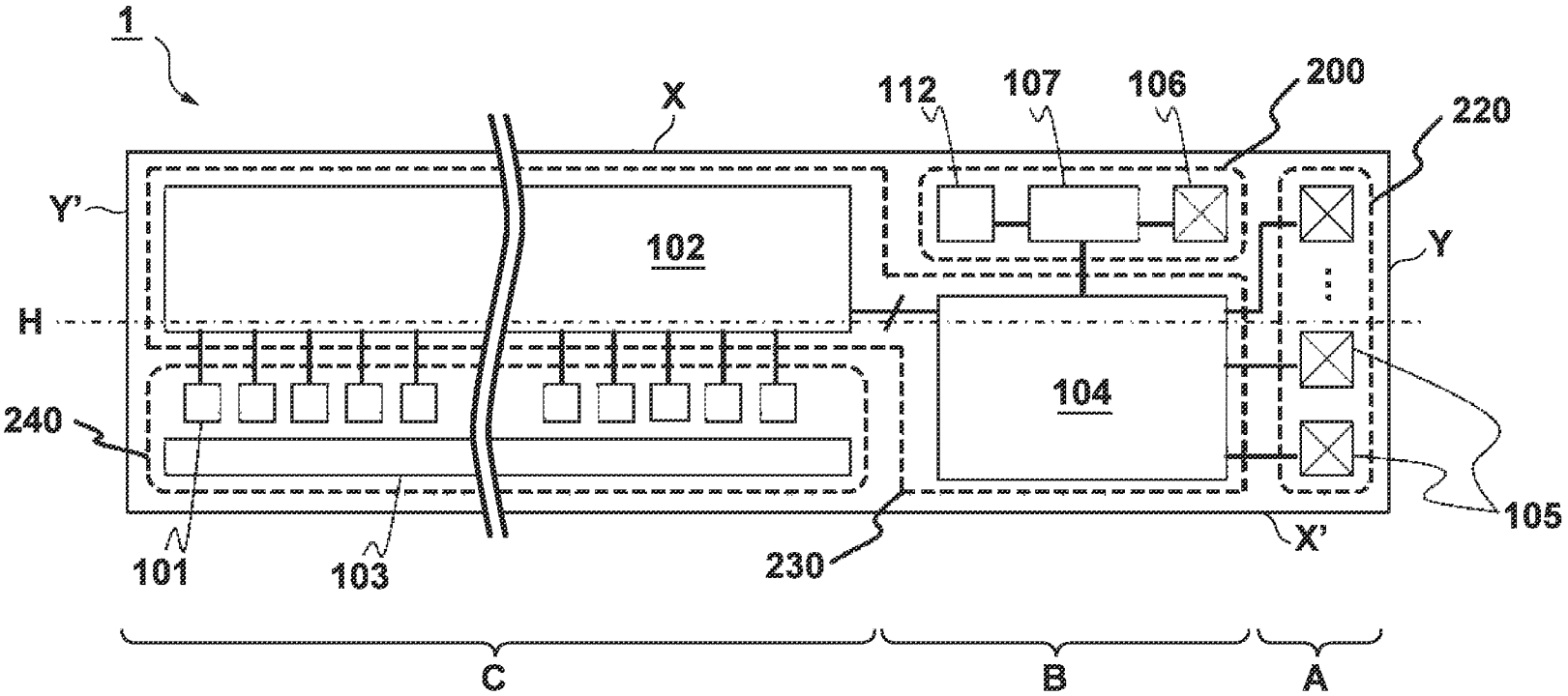
FIG. 7 is a view for explaining an example of the arrangement of a fluid discharge head semiconductor device of the second embodiment.
Figure 8:
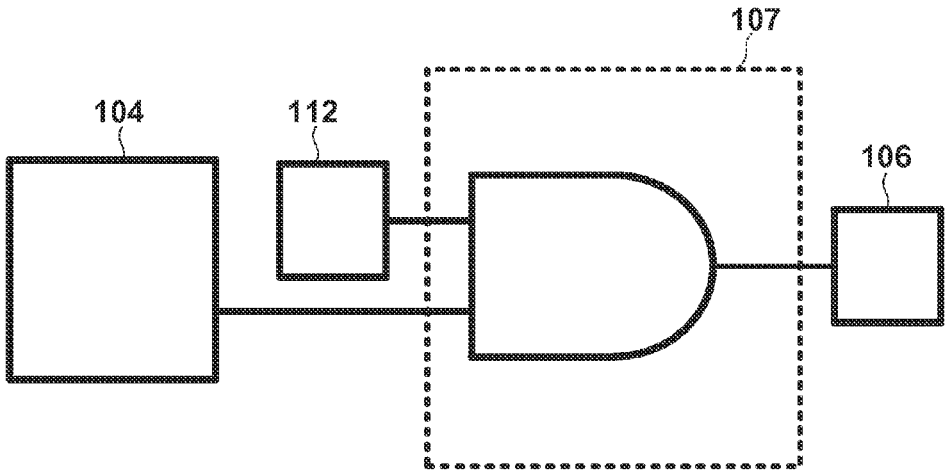
FIG. 8 is a view for explaining an arrangement example of an inspection output unit of the second embodiment.

A fluid discharge head semiconductor device 2 of the second embodiment will be explained below with reference to FIGS. 7 and 8. As shown in FIG. 7, the fluid discharge head semiconductor device 2 differs from the first embodiment in that an inspection output unit 200 further includes a mode selection pad 112. The mode selection pad 112 is a pad for selecting an inspection mode or normal mode as an operation mode, and can be connected to an output buffer unit 107. As shown in FIG. 8, an AND gate can be used as the output buffer unit 107. The inspection mode can be set by setting the mode selection pad 112 in, for example, a high state. In this mode, the output buffer unit 107 can output the result of an inspection of a logic unit 104 to second pad group 106. On the other hand, the normal mode can be set by setting the mode selection pad 112 in, for example, a low state, and the output buffer unit 107 can be set in a state of rest in this mode. Consequently, the inspection output unit 200 can prevent heat generation in the output buffer unit 107. Thus, this embodiment can achieve the same effect as that of the first embodiment.

Third Embodiment

Figure 9:
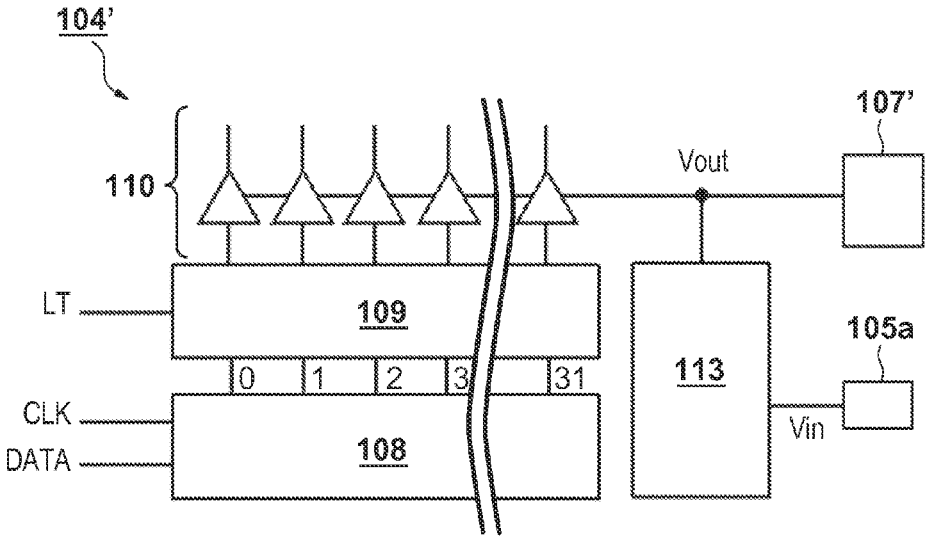
FIG. 9 is a view for explaining an arrangement example of a processing unit of the third embodiment.
Figure 10:
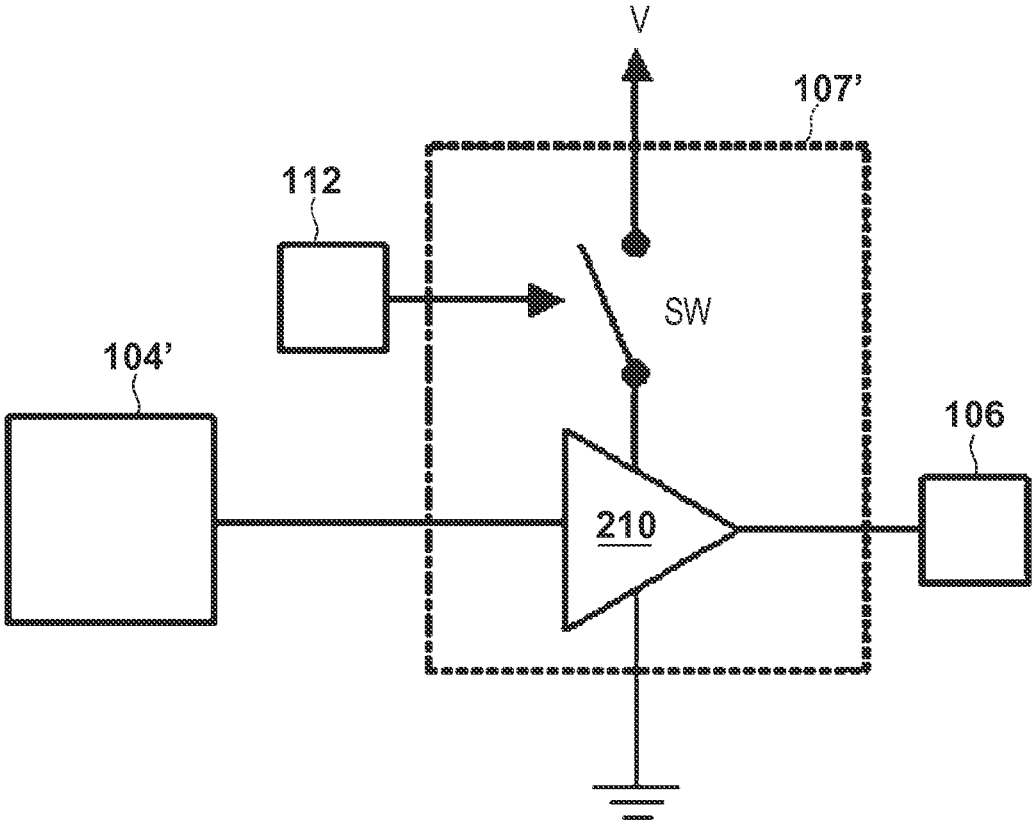
FIG. 10 is a view for explaining an arrangement example of an inspection output unit of the third embodiment.

A fluid discharge head semiconductor device 2' of the third embodiment will be explained below with reference to FIGS. 9 and 10. The fluid discharge head semiconductor device 2' mainly differs from the second embodiment in that a logic unit 104' shown in FIG. 9 and an output buffer unit 107' shown in FIG. 10 are used. Also, first pad group 105 of the fluid discharge head semiconductor device 2' can include one input pad in addition to the first pad group 105 of the fluid discharge head semiconductor device 2. This input pad can be used as a power input terminal 105*a* for inputting a power supply voltage Vin (to be described later).

The logic unit 104' can include a power supply circuit 113. The power supply circuit 113 is a voltage down circuit that receives, for example, 24 [V] as the power supply voltage Vin, and outputs, for example, 12 [V] as an output Vout, and can generate an internal power supply from an externally supplied power supply voltage. The logic unit 104' can include the power input terminal 105*a* for inputting the power supply voltage Vin to the power supply circuit 113. Vout is used as the power supply of an amplifier 110, and the amplifier 110 outputs a signal having a voltage amplitude corresponding to Vout. Each of a plurality of amplifiers 110 can be connected to a driving unit 102 for driving a plurality of printing elements 101. The driving force of the driving unit 102 can change in accordance with the signal voltage of the output of the amplifier 110. Accordingly, an electric current flowing through the recording element 101 can be controlled by using the power supply circuit 113.

Since the power supply circuit 113 as described above can be inspected in the stage of manufacture or shipment, the output Vout of the power supply circuit 113 can be connected to the output buffer unit 107'. In an inspection mode, a load capacitance can be added to second pad group 106 because they are connected to an external inspection apparatus 111. Consequently, Vout may fluctuate from the original output value. To hold the load capacitance of the power supply circuit 113 constant in the inspection mode and a normal mode, therefore, a voltage buffer 210 is used in the output buffer unit 107'.

On the other hand, in a normal use state in which printing is performed, the inspection output unit can generate heat because the output buffer unit 107' is operating. In this embodiment, a mode connection pad 112 can be connected to the output buffer unit 107'. Accordingly, the fluid discharge head semiconductor device 2' can select the inspection mode or normal mode as an operation mode.

The output buffer unit 107' can include the voltage buffer 210 and a switch SW. Vout can be input to the voltage buffer 210, and the output of the voltage buffer 210 can be connected to the second pad group 106. The voltage buffer 210 can be connected to the power supply via the switch SW. The switch SW can perform a switching operation in accordance with the state of the mode selection pad 112. In the inspection mode, the switch SW can be set in a conductive state, the power can be supplied to the voltage buffer 210, and Vout can be output to the second pad group 106. On the other hand, in the normal use state in which printing is performed, the switch SW can be set in a non-conductive state, and the power supply to the voltage buffer 210 can be interrupted. Consequently, the inspection output unit 200 can prevent heat generation in the output buffer unit 107'. As described above, this embodiment can also achieve the same effect as that of the first and second embodiments.

The fluid discharge head semiconductor devices of the three embodiments have been described above, but the present invention is not limited to these embodiments. Since the objects, states, applications, functions, and other specifications can appropriately be changed, it is of course possible to practice the present invention by another embodiment. For example, the logic unit 104 has 32 bits in the first embodiment, but can also have another bit size. Also, an NMOS transistor open drain output unit is used as the output buffer unit 107, but it is possible to use a PMOS transistor open drain output unit or bipolar transistor open collector output unit. Furthermore, although the inspection of the shift register circuit unit 108 of the logic unit 104 is taken as an example, another item can also be inspected. In addition, the output buffer unit 107 is an AND gate in the second embodiment, but it is also possible to use another logic circuit, for example, an OR, XOR, NOR, or NAND gate. The method of controlling the output state in accordance with the state of the mode selection pad 112 can also be performed using a switch or tri-state buffer. Moreover, FIGS. 5 and 10 show minimum necessary inputs and outputs, but the fluid discharge head semiconductor device can include input/output terminals and bonding pads (not shown).

Figure 11A:
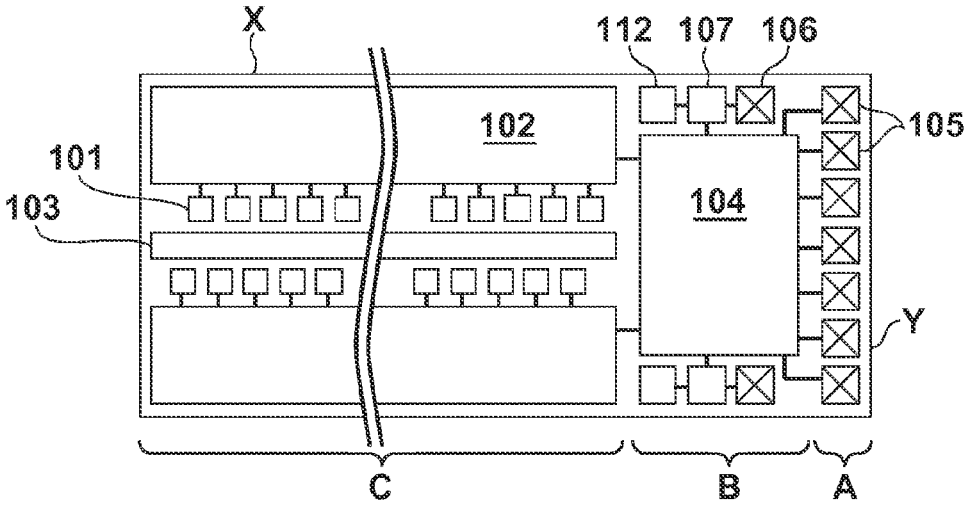
FIGS. 11A to 11E are views for explaining application examples of the fluid discharge head semiconductor devices of the embodiments.
Figure 11B:
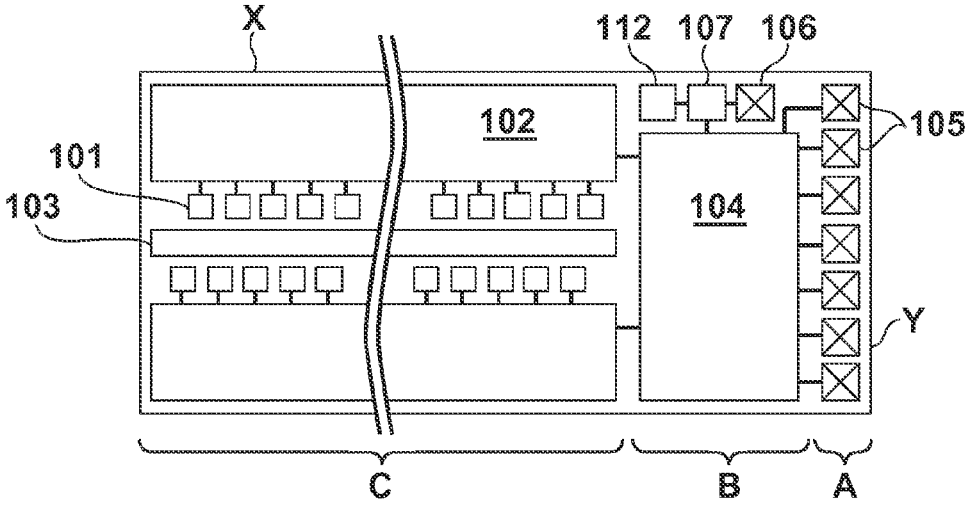
Figure 11C:
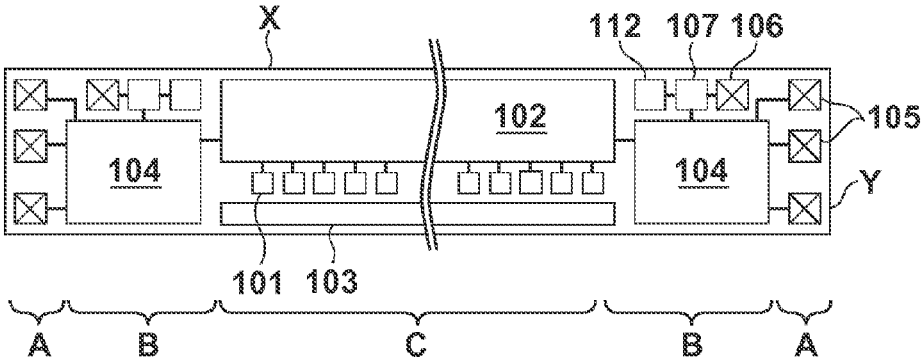
Figure 11D:
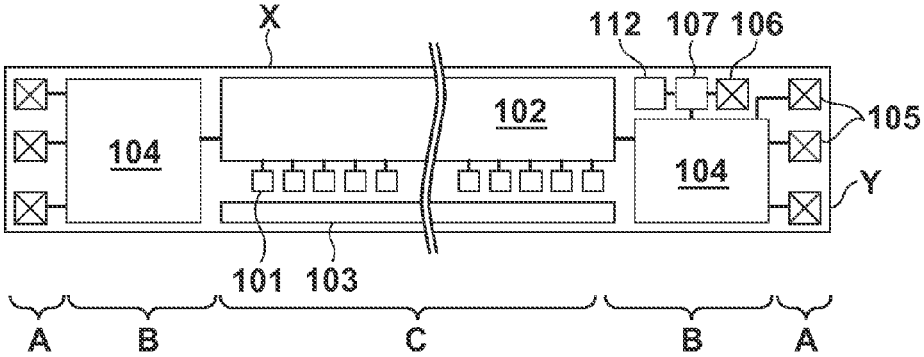
Figure 11E:
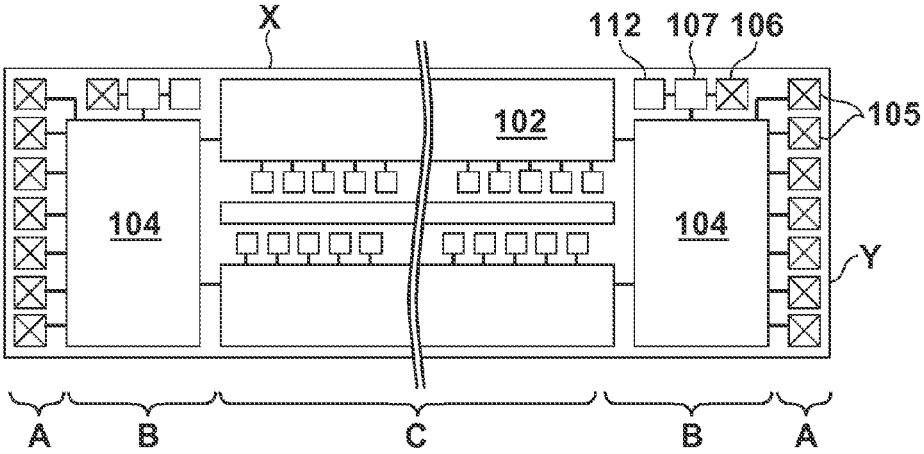

As shown in FIGS. 11A to 11E, the fluid discharge head semiconductor device of each embodiment can also be incorporated into fluid discharge head semiconductor devices in which mechanisms are effectively arranged for other purposes. FIG. 11A shows a fluid discharge head semiconductor device having a form axially symmetrical with respect to the long axis of a printing material supply unit 103. FIG. 11B shows a fluid discharge head semiconductor device having a form obtained by omitting one inspection output unit 200 from the form shown in FIG. 11A. FIG. 11C shows a fluid discharge head semiconductor device having a form axially symmetrical with respect to the end of a third area C. FIG. 11D shows a fluid discharge head semiconductor device having a form obtained by omitting one inspection output unit 200 from the form shown in FIG. 11C. FIG. 11E shows a fluid discharge head semiconductor device having a form obtained by combining these fluid discharge head semiconductor devices.

Figure 12:
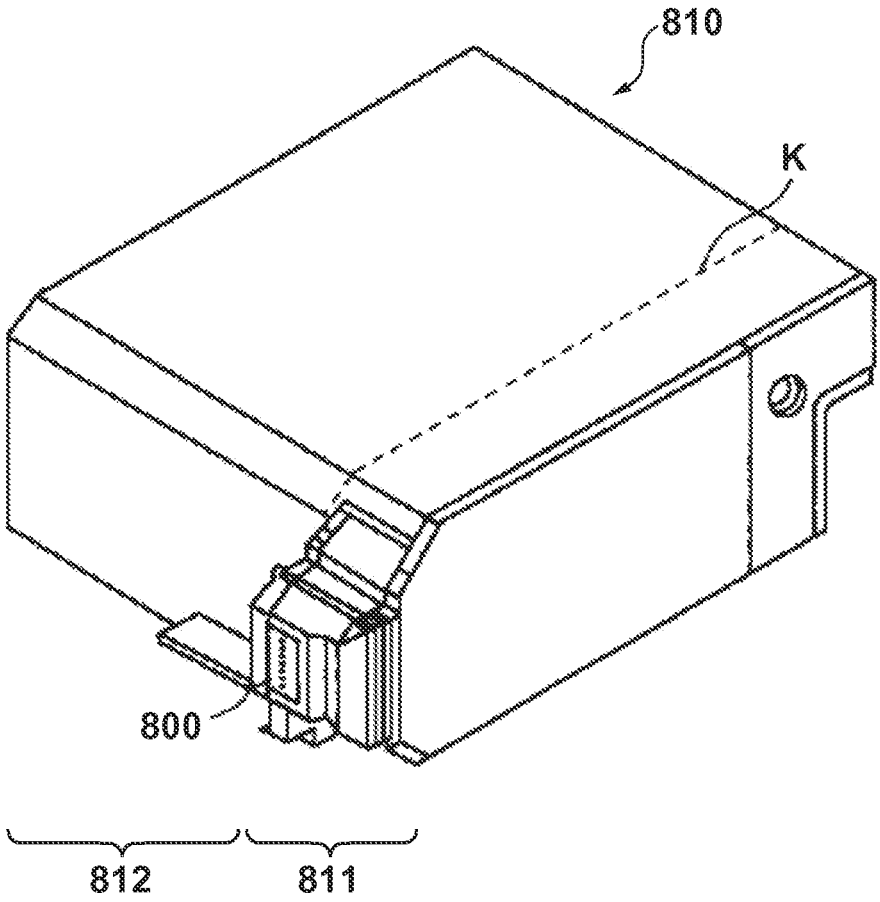
FIG. 12 is a view for explaining an arrangement example of a fluid discharge head.

The above-mentioned fluid discharge head semiconductor devices can be applied to a fluid discharge head, and incorporated in a fluid discharge apparatus. FIG. 12 is a view for explaining an example of the whole arrangement of a fluid discharge head 810. The fluid discharge head 810 can include a printing head unit 811 having a plurality of orifices 800, and a printing material container 812 for holding a printing material to be supplied to the printing head unit 811. The printing material container 812 and printing head unit 811 can be separated by, for example, a broken line K, and the printing material container 812 can be replaced. The fluid discharge head 810 can include an electrical contact (not shown) for receiving an electrical signal from a carriage 920, and perform a desired operation of discharging the printing material in accordance with this electrical signal. The recording material container 812 can include, e.g., a fibrous or porous recording material holding member (not shown), and hold the recording material by this recording material holding member.

Figure 13:
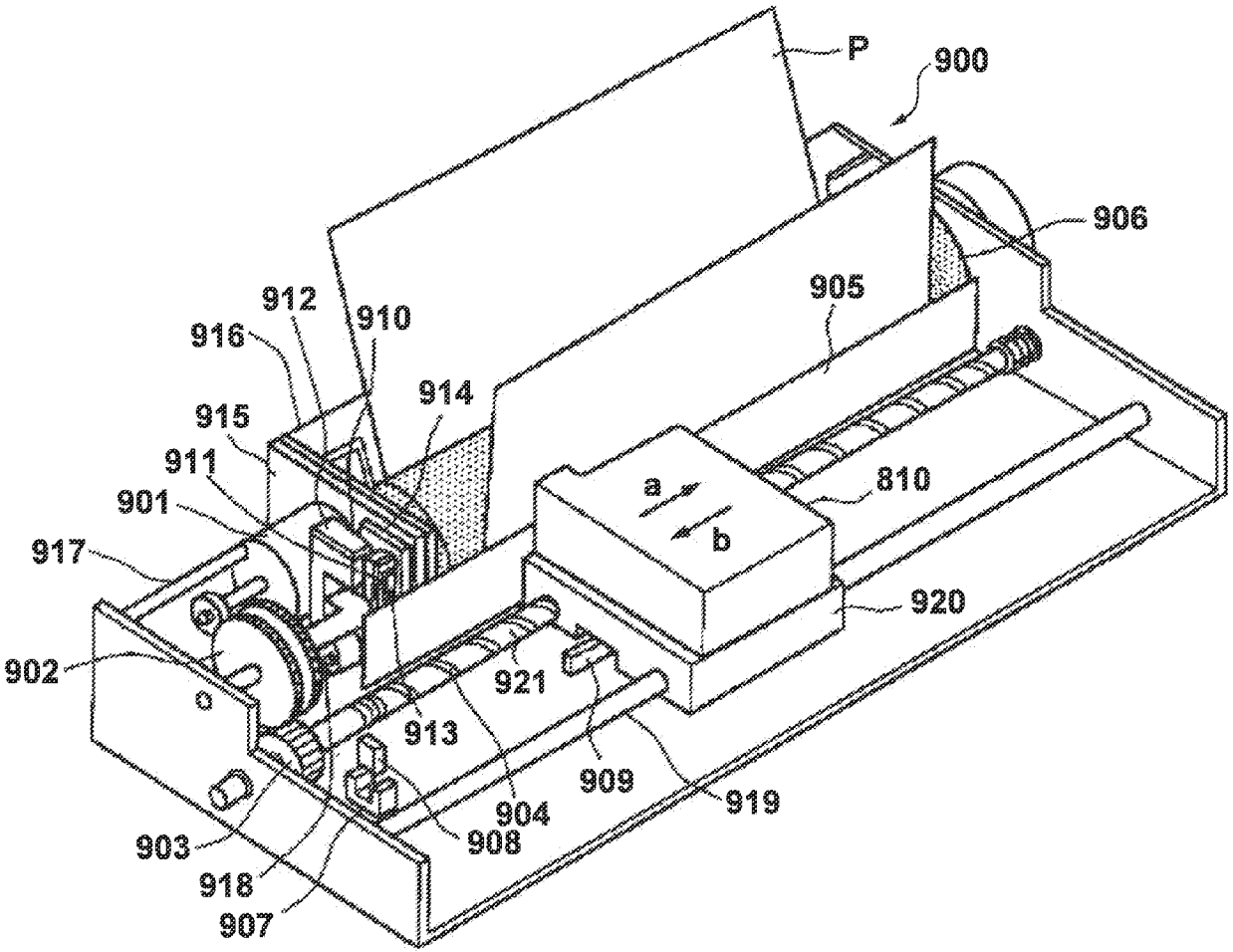
FIG. 13 is a view for explaining an arrangement example of a fluid discharge apparatus.

A fluid discharge apparatus includes an inkjet printing apparatus such as a printer, facsimile apparatus, or copying machine. A fluid discharge apparatus 900 will be explained below with reference to FIG. 13 by taking a printer as a typical example. The fluid discharge apparatus 900 includes the fluid discharge head 810 for discharging a printing material to printing paper P. The fluid discharge head 810 can be mounted on the carriage 920. The carriage 920 can be attached to a spiral groove 921 formed on a lead screw 904. The lead screw 904 can rotate in synchronism with the rotation of a driving motor 901 via driving force transmission gears 902 and 903. The fluid discharge head 810 can move together with the carriage 920 in the direction of an arrow a or b along a guide 919.

In addition, the fluid discharge apparatus 900 includes the following components. The printing paper P can be conveyed on a platen 906 by a conveying unit (not shown). A paper pressing plate 905 can press the printing paper P against the platen 906 along the carriage moving direction. The fluid discharge apparatus 900 can confirm the position of a lever 909 of the carriage 920 via photocouplers 907 and 908, and switch the rotating directions of the driving motor 901. A support member 910 can support a cap member 911 covering the entire surface of the fluid discharge head 810. A suction means 912 can evacuate the interior of the cap member 911, thereby performing suction recovery of the fluid discharge head 810 through a cap opening 913. A cleaning blade 914 can be a well-known cleaning blade. A moving member 915 can move the cleaning blade 914 forward and backward. A main body support plate 916 can support the moving member 915 and cleaning blade 914. A lever 917 can be formed to start suction of the suction recovery. The lever 917 can move as a cam 918 that engages with the carriage 920 moves, and a well-known transmitting means such as a clutch switch can control the driving force from the driving motor 901. A printing controller (not shown) can be formed in the fluid discharge apparatus 900 and control the driving of each mechanism.

The fluid discharge apparatus 900 can perform printing on the printing paper P conveyed on the platen 906 by the conveying unit (not shown), by reciprocating the fluid discharge head 810 over the entire width of the printing paper P.

Figure 14:
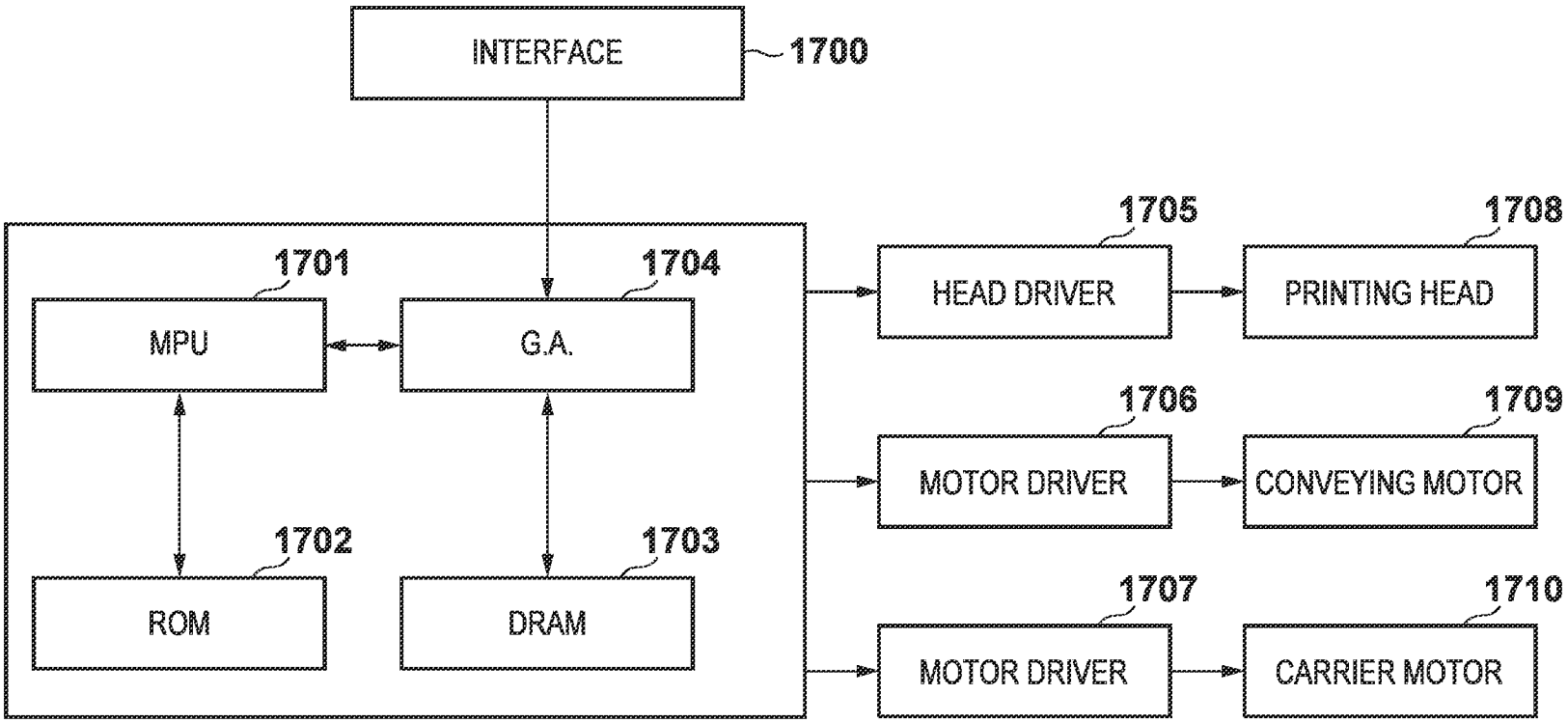
FIG. 14 is a view for explaining a system configuration example of the fluid discharge apparatus.

An example of a system configuration for executing the printing control of the fluid discharge apparatus 900 will be explained below with reference to FIG. 14. This system can include an interface 1700, MPU (Micro Processing Unit) 1701, ROM (Read Only Memory) 1702, RAM (Random Access Memory) 1703, and gate array 1704. A printing signal can be input to the interface 1700. The ROM 1702 can store a control program to be executed by the MPU 1701. The RAM 1703 can store various kinds of data (for example, the above-described printing signal and printing data supplied to a fluid discharge head 1708). The gate array 1704 can control the supply of printing data to the fluid discharge head 1708. The gate array 1704 also controls data transfer between the interface 1700, MPU 1701, and RAM 1703. This system further includes a carrier motor 1710, a conveying motor 1709, a head driver 1705, and motor drivers 1706 and 1707. The carrier motor 1710 can convey the fluid discharge head 1708. The conveying motor 1709 can convey printing paper. The head driver 1705 can drive the fluid discharge head 1708. The motor drivers 1706 and 1707 can respectively drive the conveying motor 1709 and carrier motor 1710.

When a printing signal is input to the interface 1700, this printing signal can be converted into printing data between the gate array 1704 and MPU 1701. Accordingly, these mechanisms perform their respective desired operations, thereby printing the data.

In the above description, the concept of printing includes not only the formation of intentional information such as characters and figures, but also the formation of unintentional information. Also, printing paper is used as an example of a printing medium, but it is possible to use any material capable of accepting a printing material. Examples are cloth, a plastic film, a metal plate, glass, ceramics, resin, wood, and leather. Furthermore, the concept of a printing material includes not only a fluid such as general ink for forming images, figures, and patterns on printing paper, but also a fluid for use in processing of the printing material (for example, solidification or insolubilization of a colorant contained in the printing material).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-266275, filed Dec. 5, 2011, which is hereby incorporated by reference herein in its entirety.

What is claimed is:

1. A fluid discharge head semiconductor device comprising:

a terminal unit including a first pad group including a plurality of pads;

a processing unit configured to process input information from said first pad group;

a printing unit including a plurality of printing elements configured to discharge a printing material in accordance with a result of the processing; and an inspection output unit including a second pad group including at least one pad and an output buffer unit, wherein said processing unit outputs information on an inspection of an operation to said inspection output unit, and wherein said output buffer unit is configured to output the information to said second pad group when performing an inspection, and a driving of said output buffer unit is suppressed when performing printing.

2. The device according to claim 1, wherein in a rectangular shape having two long sides and two short sides, a first area, a second area, and a third area are arranged in order from one of the two short sides to the other, said terminal unit is formed in the first area, said inspection output unit is formed in the second area, said printing unit is formed in the third area, and said inspection output unit is formed between one of the two long sides and a virtual line formed between and parallel to the two long sides, and said printing unit is formed between the virtual line and the other one of the two long sides.

3. The device according to claim 1, wherein said output buffer unit comprises an open drain output unit.

4. The device according to claim 1, wherein a ground potential is supplied to said second pad group when performing printing.

5. The device according to claim 1, wherein said output buffer unit and said second pad group are electrically insulated when performing printing.

6. A fluid discharge head comprising:

a fluid discharge head semiconductor device recited in claim 1; and a member attached to said fluid discharge head semiconductor device, that includes orifices configured to discharge the printing material in accordance with driving of the plurality of printing elements.

7. A fluid discharge apparatus comprising:

a fluid discharge head recited in claim 6; and a conveying unit configured to convey a printing medium to said fluid discharge head.

* * * * *